US007083123B2

(12) United States Patent
Molla

(10) Patent No.: US 7,083,123 B2
(45) Date of Patent: Aug. 1, 2006

(54) INTERNAL FLAME GAS BURNER WITH HIGH COMPACTNESS

(75) Inventor: Jean-Claude Molla, Beauchamp (FR)

(73) Assignee: Gaz de France, Saint Dennis la Plaine Cedex (FR)

( * ) Notice: Subject to any disclaimer, the term of this patent is extended or adjusted under 35 U.S.C. 154(b) by 118 days.

(21) Appl. No.: 10/735,684

(22) Filed: Dec. 15, 2003

(65) Prior Publication Data

US 2004/0195399 A1 Oct. 7, 2004

(30) Foreign Application Priority Data

Dec. 17, 2002 (FR) ..... 02 16041

(51) Int. Cl.
*F23D 11/16* (2006.01)
*F23D 11/40* (2006.01)
*F23D 14/62* (2006.01)

(52) U.S. Cl. ..... 239/419.5; 398/418; 398/288.5; 398/544; 398/558; 398/267; 398/432; 398/554; 431/354

(58) Field of Classification Search ..... 239/288.5, 239/544, 296, 558, 567, 398
See application file for complete search history.

(56) References Cited

U.S. PATENT DOCUMENTS 2,384,022 A * 9/1945 Fuller ..... 431/348
2,470,881 A 5/1949 Zimbelman
2,817,397 A * 12/1957 Brumbaugh ..... 239/544
3,527,199 A * 9/1970 Harwood et al. ..... 126/39 J
3,568,934 A * 3/1971 Dunn ..... 239/567
3,589,620 A * 6/1971 Davis et al. ..... 239/434
3,777,985 A * 12/1973 Hughes et al. ..... 239/555
3,877,865 A * 4/1975 Duperow ..... 431/349
6,089,219 A * 7/2000 Kodera et al. ..... 126/39 R
6,129,545 A 10/2000 Kahlke et al.
6,322,354 B1 * 11/2001 Carbone et al. ..... 431/284
6,457,970 B1 10/2002 Park
6,780,008 B1 * 8/2004 Koch et al. ..... 431/354

FOREIGN PATENT DOCUMENTS

BE 496727 11/1950

(Continued)

OTHER PUBLICATIONS

International Search Report for Application No. FR 0216041, dated Apr. 28, 2003, 2 pages.

*Primary Examiner*—David A. Scherbel
*Assistant Examiner*—James S. Hogan
(74) *Attorney, Agent, or Firm*—Harness, Dickey & Pierce, P.L.C.

(57) ABSTRACT

The invention relates to an internal flame gas burner comprising a gas injector (1), a vacuum tube (2), and an annular chamber (5) formed by a pot (3) covered by a cap (4), the chamber having an internal edge (51) perforated with flame exit ports (510), and the tube (2) having a convergent section open to the ambient air at an inlet end, and a divergent section succeeding the convergent section, ending at the outlet of the tube and opening out into the chamber, the injector being relatively closer to the inlet of the tube than to the outlet.

According to the invention, the tube extends longitudinally along an axis (X) contained in a mid-plane (P) of the annular chamber, this tube having a length (L2) at most equal to twice the greatest distance (R) separating the internal edge (51) of the chamber from the center (50) of this chamber.

12 Claims, 4 Drawing Sheets

FOREIGN PATENT DOCUMENTS

| | | | |
|---|---|---|---|
| BE | 496727 A | * | 11/1950 |
| CH | 106654 | | 9/1923 |
| DE | 3918715 A1 | | 11/1990 |
| FR | 2 692 024 | | 6/1992 |

* cited by examiner

Fig. 2
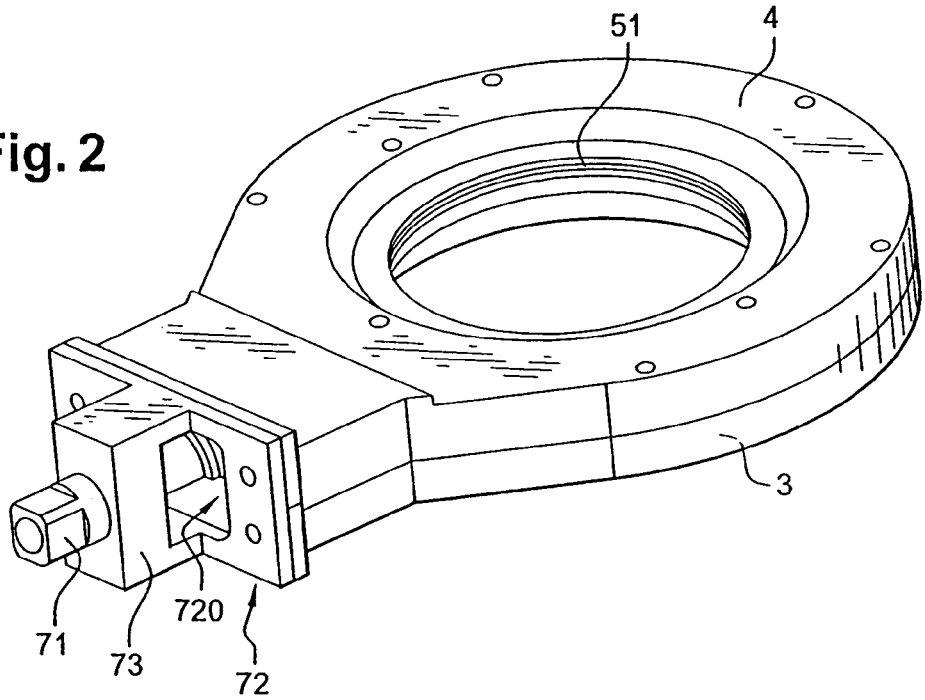
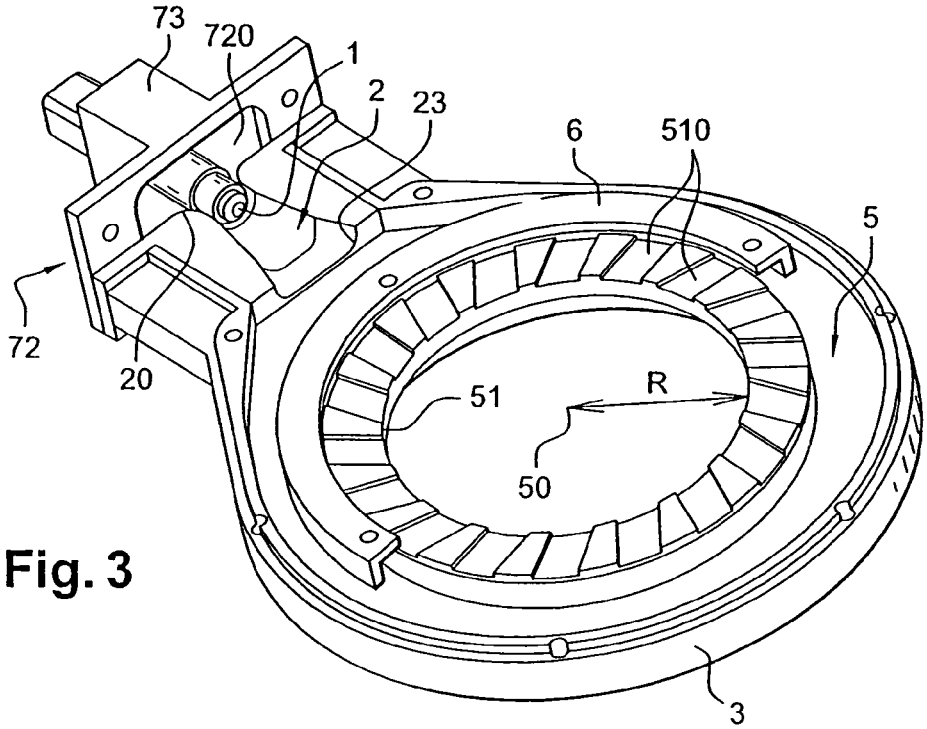
Fig. 3

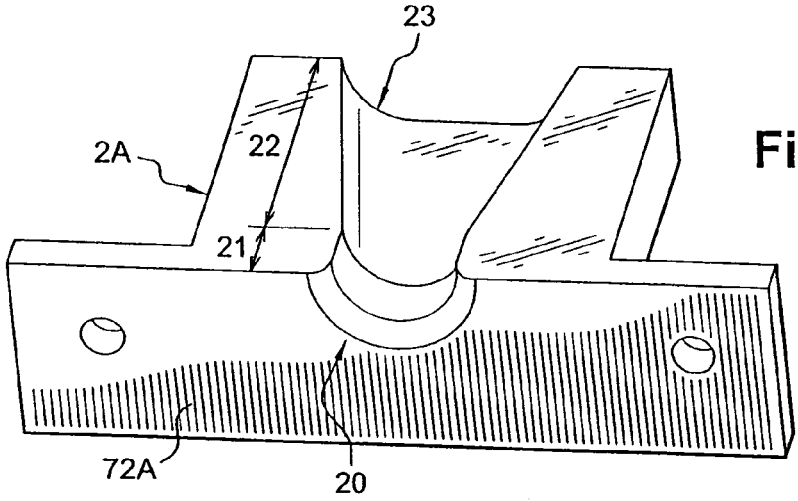
Fig. 6
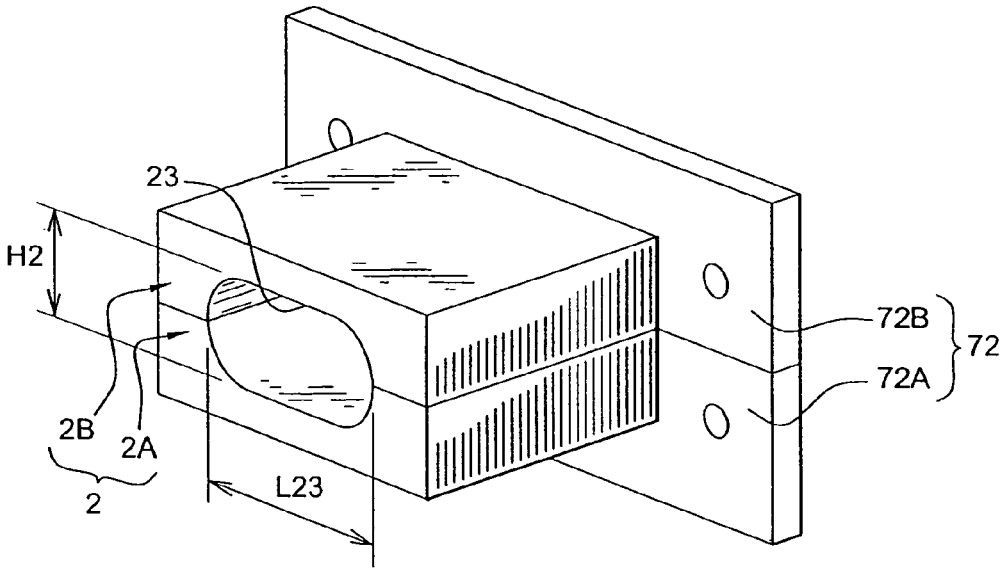
Fig. 7
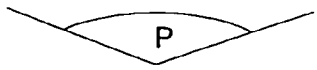

INTERNAL FLAME GAS BURNER WITH HIGH COMPACTNESS

The invention relates in general to the field of so-called "internal flame" gas burners, i.e., wherein the flames converge towards a heat concentration point.

More precisely, the invention relates to an internal flame gas burner comprising a gas injector, a vacuum tube, or venturi, ensuring an induction of primary air, a pot, and a cap, the cap covering the pot and together with the pot defining an annular distribution chamber for a fuel mixture of air and gas, the chamber having an internal edge that surrounds the center of this chamber and that is perforated with flame exit ports, and the vacuum tube having an inlet open to the ambient air, first and second longitudinal sections having, respectively, convergent and divergent profiles, and an outlet opening into the annular chamber, the first section originating at the inlet of the tube, the second section succeeding the first section and ending at the outlet of the tube, and the injector being relatively closer to the inlet of the vacuum tube than to the outlet of this tube.

Gas burners such as those that traditionally equip cook tops and professional cook stoves are designed such that the fuel mixture is admitted into the annular chamber in an upward movement, and belong to the so-called "external flame" type of burners wherein the flames diverge radially towards the outside.

In terms of performance, reliability and economic viability, these burners provide results that are quite satisfactory overall, but nevertheless likely to be optimized and obtained at the cost of large spatial requirements.

More recent developments have led to the appearance of burners of the so-called "internal flame" type, as previously defined, i.e., wherein the flames converge towards a central point.

The burners of this type, e.g., as described in patents JP-11-211089 and JP-2000-97409, have inherently attractive properties in terms of dynamic power range, energy efficiency, and heat-loss reduction, the dynamic range being represented by the ratio of the highest flow rate likely to be attained while still maintaining a clean combustion and a flame adhered to the exit port, to the lowest flow rate likely to be attained without any flashback into this exit port.

Although structurally different from external flame burners, internal flame burners, however, are still derived from the former by the application of traditional design principles, and therefore inherit some of the characteristics of these former burners.

Within this context, the purpose of the invention is to propose an internal flame burner having a stand-alone alone design in comparison with external flame burners, and thus free from the limitations attributable to the latter.

To this end, the gas burner of the invention, in addition to being consistent with the generic definition of it given in the above preamble, is essentially characterized in that the vacuum tube extends longitudinally along an axis inscribed substantially in a mid-plane of the annular chamber, and in that this tube has a length at most equal to twice the greatest distance separating the internal edge of the chamber from the center of this chamber.

While such dimensions were not initially capable of being anticipated by one skilled in the art, the burner of the invention has excellent performance levels, despite its very small spatial requirement.

The internal edge of the annular chamber is, for example, circular, the length of the tube thus being at most equal to the diameter of the internal edge of the chamber, or even at most equal to the radius of this internal edge.

In the preferred embodiment of the invention, the tube opens out into the chamber in a radial direction in relation to the internal edge of the latter, and this chamber is equipped with a distribution baffle for the fuel mixture, shaped like an arc of a circle and interposed between the outlet of the tube and at least some of the flame exit ports arranged opposite this outlet.

This baffle advantageously occupies only a portion of the height of the chamber, and is arranged closer to the cap than to the pot.

Preferably, the outlet of the tube has respectively, in the mid-plane and perpendicular to the mid-plane, a width and a height, the height being less than the width.

In this case, it is advantageous to ensure that, perpendicular to the mid-plane, the second section of the tube has a substantially constant height up to the outlet of the tube.

The second section of the tube and the chamber may therefore have substantially equal heights, perpendicular to the mid-plane.

The gas burner of the invention may further comprise a device for holding the injector, itself including a gas inlet line, a support plate, and a stirrup, the injector being mounted at a free end of the gas inlet line, the support plate being integral with the vacuum tube and having an opening opposite the inlet of this tube, and the stirrup being integral with the support plate and supporting the gas inlet line at a distance from the opening of the support plate.

The injector preferably opens out into the first section of the vacuum tube.

Finally, the vacuum tube may be formed from two parts that are substantially symmetrical to each other with respect to the mid-plane of the annular chamber.

Other characteristics and advantages of the invention will become apparent from the following description given for informational and entirely non-limiting purposes, with reference to the appended drawings wherein:

FIG. 2 is a perspective view of a burner in accordance with the invention, shown in full and viewed from the side of its injector;

FIG. 3 is a perspective view of a burner in accordance with the invention, viewed prior to the mounting of its cap and the upper half of its vacuum tube;

FIG. 6 is a perspective view of the lower half of the vacuum tube of a burner in accordance with the invention, viewed from its inlet side; and FIG. 7 is a perspective view of the vacuum tube of a burner in accordance with the invention, viewed from its outlet side.

Figure 1:
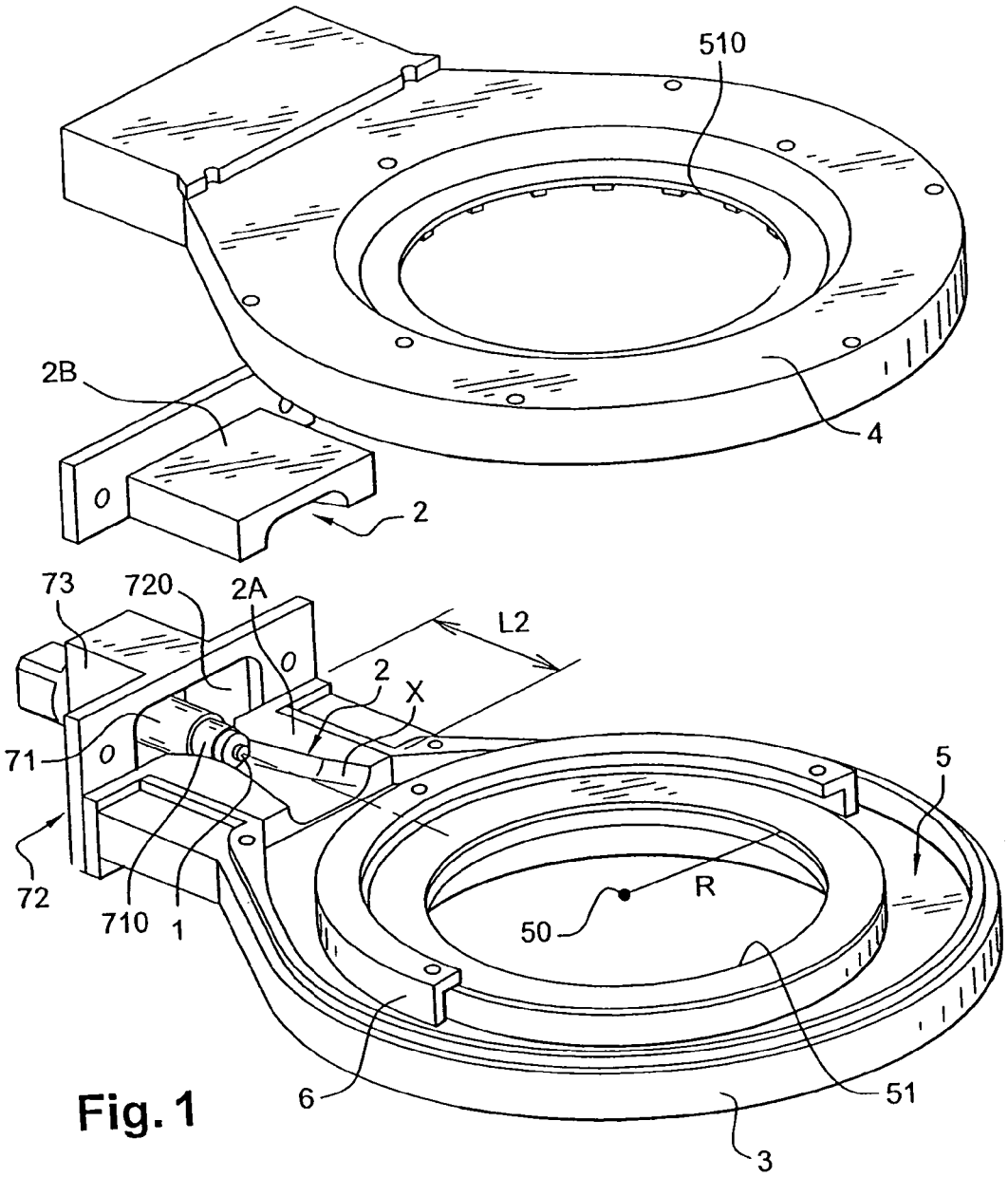
FIG. 1 is a partially exploded perspective view of a burner in accordance with the invention.

As stated previously, the invention relates to an internal flame gas burner.

As shown in the aforementioned Japanese patents, a burner such as this includes a gas injector 1, a vacuum tube 2, a pot 3, and a cap 4.

The vacuum tube 2, also called a "venturi", has the role of ensuring an induction of primary combustion air, this induction of air, or suction, resulting from the vacuum created in the tube 2 by the gas exiting from the injector 1, and being accompanied by turbulence owing to which the primary air mixes with the gas.

The cap 4 covers the pot 3 and, together with this pot 3, defines an annular chamber 5 the internal edge 51 of which surrounds the center 50 of this chamber, and has flame exit ports 510.

The air and the gas coming from the tube 2 finish mixing together thoroughly inside this chamber 5, the resulting fuel mixture being evenly apportioned and dispensed towards the flame exit ports 510, where it is ignited and burns together with a supply of secondary ambient air.

The vacuum tube 2 has an inlet 20 open to the ambient air, a first longitudinal section 21, a second longitudinal section 22, and an outlet 23 opening out into the annular chamber 5.

The first section 21 originates at the inlet 20 of the tube 2 and has a convergent profile.

The second section 22 succeeds the first section 21, has a divergent profile, and ends at the outlet 23 of the tube.

In addition, the injector 1 is arranged in closer proximity to the inlet 20 of the vacuum tube 2 than to the outlet 23 of this tube.

On the one hand, according to the invention, the vacuum tube 2 extends longitudinally along an axis X that is substantially contained within the mid-plane P of the annular chamber 5.

And, on the other hand, this tube 2 has a length L2 that is at most equal to twice the greatest distance R separating the internal edge 51 of the chamber 5 from the center 50 of this chamber.

In the preferred case where the internal edge 51 of the annular chamber 5 is circular, the length L2 of the tube 2 is therefore at most equal to twice the radius R of this internal edge 51, i.e., to the diameter of this same edge 51.

In practice, it is even advantageous to give the tube 2 a length L2 at most equal to the radius R of the internal edge 51 of the chamber 5.

Figure 4:
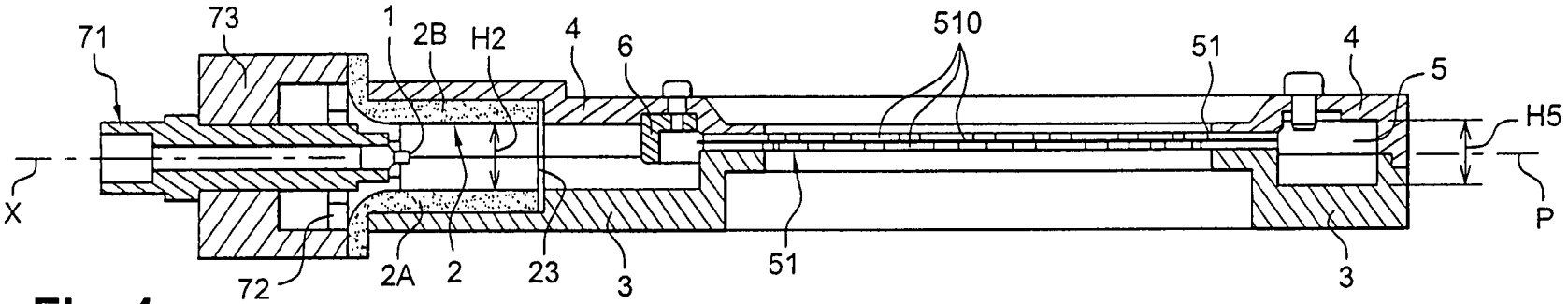
FIG. 4 is a sectional view of a burner in accordance with the invention, the section being made along a plane containing the axis of the vacuum tube and perpendicular to the mid-plane of the annular chamber.

As shown, in particular, in FIGS. 3 and 4, the vacuum tube 2 opens out into the chamber 5 in a radial direction in relation to the internal edge 51 of this chamber.

In order to obtain an even distribution of the fuel mixture towards the various ports 510, the chamber 5 is equipped with a baffle 6, shaped like an arc of a circle and interposed between the outlet 23 of the tube 2 and those flame exit ports 510 that are arranged opposite this outlet 23.

The baffle 6 is, for example, fastened to the cap 4 (FIG. 4) and, in any event, is preferably arranged closer to the cap 4 than to the pot 3, this baffle occupying only a portion of the height H5 of the chamber.

According to one very advantageous feature of the invention (FIG. 7), the width L23 of the outlet 23 of the tube 2, i.e., the dimension that this outlet 23 has in the mid-plane P of the chamber 5, is greater than the height H2 of this outlet 23, i.e., than the dimension that the outlet 23 of the tube 2 has perpendicular to the mid-plane P of the chamber 5.

In actual fact, the width L23 of the outlet 23 of the tube 2 is virtually equal to twice the height H2 of this outlet.

Figure 5:
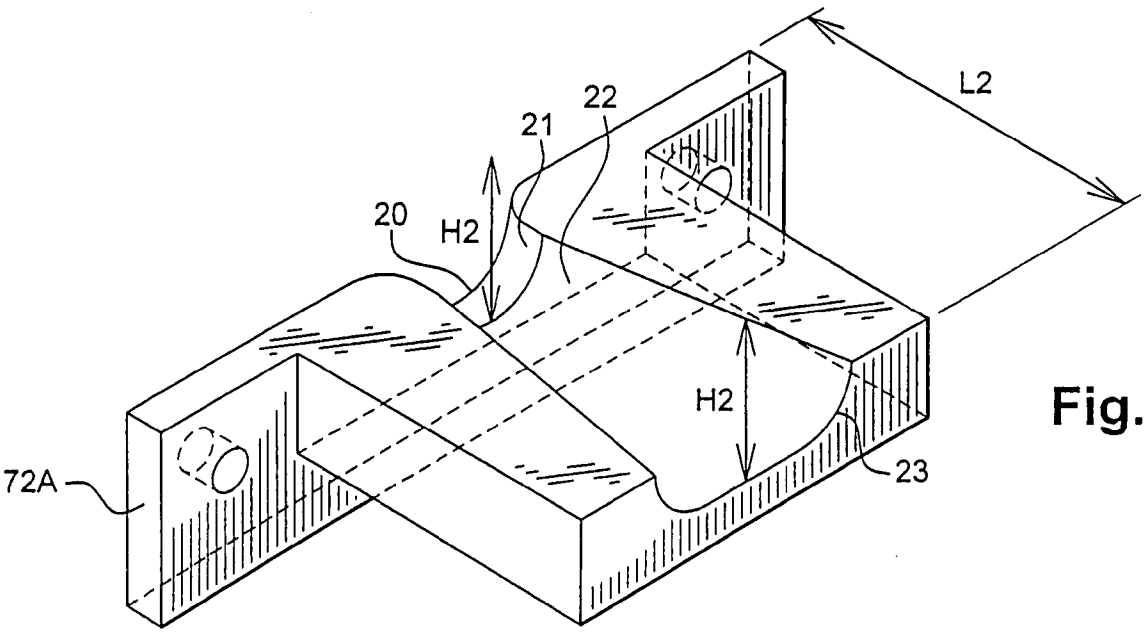
FIG. 5 is a perspective view of the lower half of the vacuum tube of a burner in accordance with the invention, viewed from its outlet side.

As shown in FIG. 5, the height of the second section 22 of the vacuum tube 2, perpendicular to the mid-plane P, may be substantially constant up to the outlet 23 of the tube, and therefore equal to the height H2 of this outlet 23.

Furthermore, the height H2 of the second section 22 of the tube 2 (FIG. 4) is advantageously equal to the height H5 of the chamber 5.

The internal flame gas burner of the invention further comprises a device 7 for holding the injector 1, this device itself including a gas inlet line 71, a support plate 72, and a stirrup 73.

The injector is mounted at the free end 710 of the gas inlet line 71, this line being held by the stirrup 73.

The support plate 72 is integral with the vacuum tube 2 and has an opening 720, opposite the inlet 20 of this tube 2, which promotes the circulation of primary air inside the tube 2.

The stirrup 73, which is integral with the support plate 72, supports the gas inlet line 71 at a distance from the opening of the support plate 72, thereby clearing this opening to further promote the air circulation.

As best shown in FIG. 4, the injector 1 opens out into the first section 21 of the vacuum tube 2, very close to the connection area of the first and second sections.

Finally, as best shown in FIGS. 5 to 7, the vacuum tube 2 is advantageously formed by a stacking of two parts 2A and 2B, these two parts being capable, therefore, of being substantially symmetrical to each other with respect to the mid-plane P of the annular chamber 5.

The invention claimed is:

1. Internal flame gas burner comprising a gas injector, a vacuum tube, or venture, ensuring an induction of primary air, a pot, and a cap, the cap covering the pot and together with the pot defining an annular distribution chamber for a fuel mixture of air and gas, the chamber having an internal edge that surrounds the center of this chamber and that is perforated with flame exit ports, and the vacuum tube having an inlet open to the ambient air, first and second longitudinal sections having, respectively, convergent and divergent profiles, and an outlet opening into the annular chamber, the first section originating at the inlet of the tube, the second section succeeding the first section and ending at the outlet of the tube, and the injector being relatively closer to the inlet of the vacuum tube than to the outlet of this tube, characterized in that the vacuum tube extends longitudinally along an axis inscribed substantially in a mid-plane of the annular chamber, and in that this tube has a length at most equal to twice the greatest distance separating the internal edge of the chamber from the center of this chamber.

2. Internal flame gas burner as claimed in claim 1, characterized in that the internal edge of the chamber is circular.

3. Internal flame gas burner as claimed in claim 2, characterized in that the length of the tube is at most equal to the diameter of the internal edge of the chamber.

4. Internal flame gas burner as claimed in claim 2, characterized in that the length of the tube is at most equal to the radius of the internal edge of the chamber.

5. Internal flame gas burner as claimed in claim 2, characterized in that the tube opens out into the chamber in a radial direction in relation to the internal edge of the latter, and in that this chamber is equipped with a distribution baffle for the fuel mixture, shaped like an arc of a circle and interposed between the outlet of the tube and at least some of the flame exit ports arranged opposite this outlet.

6. Internal flame gas burner as claimed in claim 1, characterized in that the outlet of the tube has respectively, in the mid-plane and perpendicular to the mid-plane, a width and a height, the height being less than the width.

7. Internal flame gas burner as claimed in claim 6, characterized in that, perpendicular to the mid-plane, the second section of the tube has a substantially constant height up to the outlet of the tube.

8. Internal flame gas burner as claimed in claim 7, characterized in that, perpendicular to the mid-plane, the second section of the tube and the chamber have substantially equal heights.

9. Internal flame gas burner as claimed in claim 5, characterized in that the baffle occupies only a portion of the height of the chamber, and is arranged closer to the cap than to the pot.

10. Internal flame gas burner, as claimed in claim 1, characterized in that it comprises a device for holding the injector, itself including a gas inlet line, a support plate, and a stirrup, the injector being mounted at a free end of the gas inlet line, the support plate being integral with the vacuum plate and supporting the gas inlet line at a distance from the opening of the support plate.

11. Internal flame gas burner as claimed in claim 1, characterized in that the injector opens out into the first section of the vacuum tube.

12. Internal flame gas burner as claimed in claim 1, characterized in that the vacuum tube is formed from two parts that are substantially symmetrical to each other with respect to the mid-plane of the annular chamber.

* * * * *